US009212877B2

(12) United States Patent
Valledor et al.

(10) Patent No.: US 9,212,877 B2
(45) Date of Patent: Dec. 15, 2015

(54) RETENTION SYSTEM FOR A DEPLOYABLE PROJECTILE FIN

(75) Inventors: Christian A. Valledor, Fort Leavenworth, KS (US); John A. Condon, Timonium, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 533 days.

(21) Appl. No.: 13/542,041

(22) Filed: Jul. 5, 2012

(65) Prior Publication Data

US 2014/0008483 A1 Jan. 9, 2014

(51) Int. Cl.
*F42B 10/14* (2006.01)
*F42B 10/06* (2006.01)

(52) U.S. Cl.
CPC ..... *F42B 10/14* (2013.01); *F42B 10/06* (2013.01)

(58) Field of Classification Search
CPC ..... F42B 10/14; F42B 10/18; F42B 10/06
USPC ..... 244/3.24, 3.27, 3.28, 3.3; 102/385, 490, 102/501
See application file for complete search history.

(56) References Cited

U.S. PATENT DOCUMENTS

| | | | | | |
|---|---|---|---|---|---|
| 1,509,336 | A | * | 9/1924 | Borden | 102/385 |
| 3,819,132 | A | * | 6/1974 | Rusbach | 244/3.28 |
| 3,845,922 | A | * | 11/1974 | Mayer | 244/3.28 |
| 4,332,360 | A | * | 6/1982 | Topliffe | 244/3.27 |
| 4,334,657 | A | * | 6/1982 | Mattson | 244/3.28 |
| 4,431,147 | A | * | 2/1984 | Paley | 244/3.3 |
| 4,444,115 | A | * | 4/1984 | Romer et al. | 102/431 |
| H905 | H | * | 4/1991 | Rottenberg | 244/3.28 |
| H1412 | H | * | 2/1995 | Kline et al. | 102/521 |
| 5,474,256 | A | * | 12/1995 | Garner | 244/3.24 |
| 5,503,080 | A | * | 4/1996 | Goward et al. | 102/293 |
| 5,685,503 | A | * | 11/1997 | Trouillot et al. | 244/3.28 |
| 5,780,766 | A | | 7/1998 | Schroppel | |
| 6,272,997 | B1 | * | 8/2001 | James et al. | 102/293 |
| 6,314,886 | B1 | * | 11/2001 | Kuhnle et al. | 244/3.28 |
| 6,588,700 | B2 | * | 7/2003 | Moore et al. | 244/3.28 |
| 6,764,042 | B2 | * | 7/2004 | Moore et al. | 244/3.28 |
| 7,083,140 | B1 | * | 8/2006 | Dooley | 244/3.27 |
| 7,100,865 | B2 | * | 9/2006 | Byrne et al. | 244/3.28 |
| 7,308,981 | B1 | * | 12/2007 | Noel Du Payrat et al. | 206/3 |
| 7,628,353 | B2 | * | 12/2009 | Peterson | 244/3.28 |
| 7,851,734 | B1 | * | 12/2010 | Hash et al. | 244/3.27 |
| 8,387,508 | B2 | * | 3/2013 | Niemi et al. | 89/1.806 |
| 8,415,598 | B1 | * | 4/2013 | Terhune et al. | 244/3.28 |

(Continued)

OTHER PUBLICATIONS

U.S. Army Research Laboratory Technical Report titled "Tactical Means to Stow Super-Caliber Tailfins of a Developmental Flight-Controlled Mortar" by Christian A. Valledor and John A. Condon.

(Continued)

*Primary Examiner* — Tien Dinh
*Assistant Examiner* — Steven Hawk
(74) *Attorney, Agent, or Firm* — Christos K. Kyriakou

(57) ABSTRACT

A fin retention system having a plurality of fin retention units and in which each unit is associated with one deployable fin of the projectile. Each retention unit has an alignment device and a pair of span arms extending outwardly from opposite sides of the alignment device. An attachment device attaches the free ends of the span arms of adjacent fin retention units together. In doing so, the alignment device engages and holds each fin in its undeployed position.

20 Claims, 3 Drawing Sheets

(56) References Cited

U.S. PATENT DOCUMENTS

| | | | | |
|---|---|---|---|---|
| 2003/0071166 | A1* | 4/2003 | Moore et al. | 244/3.28 |
| 2004/0108412 | A1* | 6/2004 | Moore et al. | 244/3.24 |
| 2007/0084961 | A1* | 4/2007 | Johnsson et al. | 244/3.28 |
| 2008/0000781 | A1* | 1/2008 | Noel Du Payrat et al. | 206/3 |

OTHER PUBLICATIONS

M395 Precision Guided Mortar Munition (PGMM). Defense Update. 2006. http://defenseupdate.com/products/x/xm395.htm (accessed 2011).

* cited by examiner

RETENTION SYSTEM FOR A DEPLOYABLE PROJECTILE FIN

GOVERNMENT INTEREST

The invention described herein may be manufactured, used, and licensed by or for the United States Government.

BACKGROUND OF THE INVENTION

I. Field of the Invention

The present invention relates to a fin retention system for a projectile having deployable fins to hold the fins in their undeployed position until after launch.

II. Description of Related Art

Many projectiles, such as mortars, missiles, and the like, have deployable fins, i.e. fins that are movable between an undeployed position and a deployed position. In their undeployed position, the fins are folded or pivoted towards the projectile thus reducing the overall diameter of the projectile around its fins. Conversely, upon deployment, the fins pivot or fold outwardly to their deployed position thus increasing the overall circumference of the projectile around the fins (i.e., super-caliber fins).

In practice, the fins are maintained in their undeployed position all the way through the launch of the projectile from a launch tube. It is only after the projectile exits from the launch tube that the projectile fins move to their deployed position. Any conventional means, such as springs, or simply the inertia of the fins may be used to move the fins to their deployed position immediately after exiting from the launch tube.

There have been previously known methods and devices to hold the fins in their undeployed position until immediately after launch. For example, there have been previously known active electric or mechanical actuators which move the fins from their undeployed and to their deployed position immediately after launch. These systems, however, are relatively expensive and heavy in construction. Furthermore, since these systems are active systems, the failure of the fin deployment system can occur, possibly with catastrophic results.

Still other systems, such as Kevlar strings and passive bore guides similar to a sabot, have also been previously known to hold the fins in their undeployed position until immediately after launch. These previously known systems have all suffered various disadvantages such as high cost and insufficient reliability.

SUMMARY OF THE PRESENT INVENTION

The present invention provides an externally mounted fin retention system for a projectile having deployable fins which overcomes the above mentioned disadvantages of the previously known devices.

In brief, the fin retention system of the present invention comprises a plurality of identical fin retention units wherein each fin retention unit is associated with one of the deployable fins of the projectile and, whereby, each fin deploys independently of the others. Thus, a projectile having three independently-deploying fins will have three fin retention units, a projectile having four independently-deploying fins will have four fin retention units, and so forth.

Each fin retention unit includes an alignment device and a pair of generally planar span arms. The span arms protrude laterally outwardly from opposite sides of the alignment device.

An attachment device is positioned adjacent to a free end of one of the span arms for each retention unit while a cooperating attachment device is positioned adjacent to a free end of the other of the span arms. Each attachment device is dimensioned to lock with its cooperating attachment device and, preferably, the attachment device and cooperating attachment device are snap locks.

With the fins of the projectile in an undeployed position, one alignment device is aligned with each fin. Simultaneously, the attachment device of each retention unit is attached to the cooperating attachment device of the adjacent retention unit. This locks the retention units in place surrounding both the projectile and the undeployed fins. A pin on each alignment device preferably engages a receiving notch in the projectile fin so that, with the fin retention units positioned around the undeployed fins and locked together, the fin retention system is not only locked against axial movement relative to the projectile, but also holds the undeployed fins in their undeployed position.

In order to launch the projectile, the projectile with its attached fin retention unit is positioned within the launch tube. Separating the fin retention system from the projectile immediately after launch, i.e. upon exiting from the launch tube, may be achieved in different fashions. For example, the fin retention units may be constructed of a combustible material so that, during launch, the combustion products from the projectile launch also combust the fin retention system to such a degree that any remaining remnants of the fin retention units after launch will be separated from the projectile by inertial and/or aerodynamic drag forces. Alternatively, the fin retention units may be constructed of a flame-retardant material and simply separate from the projectile immediately after launch by breaking away from the projectile through inertial and/or aerodynamic drag forces.

The fin retention system of the present invention enjoys low cost and high reliability due in large part to its simplicity, lack of moving parts and suitability for being mass produced. The fin retention system of the present invention relies solely upon existing events during the launch of the projectile in order to separate the fin retention system from the projectile.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 2:
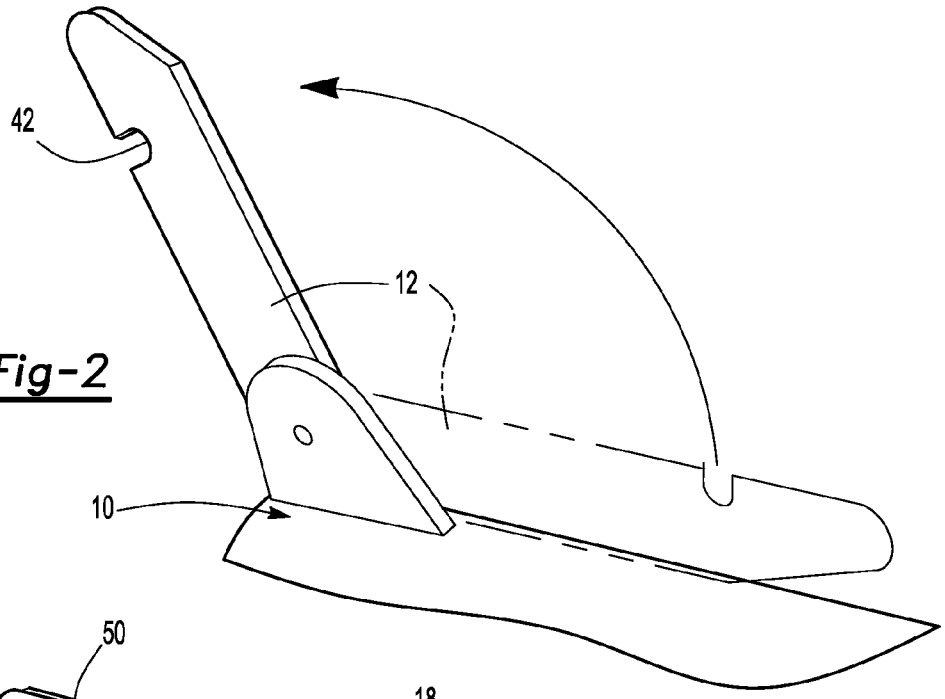
FIG. 2 is a partial view illustrating a portion of a projectile.

With reference first to FIG. 2, a projectile 10 having deployable fins 12 (only one shown in FIG. 2) is illustrated. The projectile 10 may be of any conventional construction, such as a mortar, missile, or the like.

The deployable fins 12 are movable from their undeployed position, illustrated in phantom line in FIG. 2, and their deployed position, illustrated in solid line in FIG. 2. When the fins 12 are in their undeployed position, the overall diameter of the projectile is reduced thus facilitating not only shipping and storage of the projectile 10, but also enabling the projectile with its undeployed fins 12 to be positioned within a launch tube 15 (FIG. 1).

The number of fins 12 may vary for different projectiles 10. However, typically each projectile 10 includes at least three fins 12 and usually not more than four or five. Additionally, the fins 12 are usually equidistantly circumferentially spaced around the projectile 10.

Figure 1:
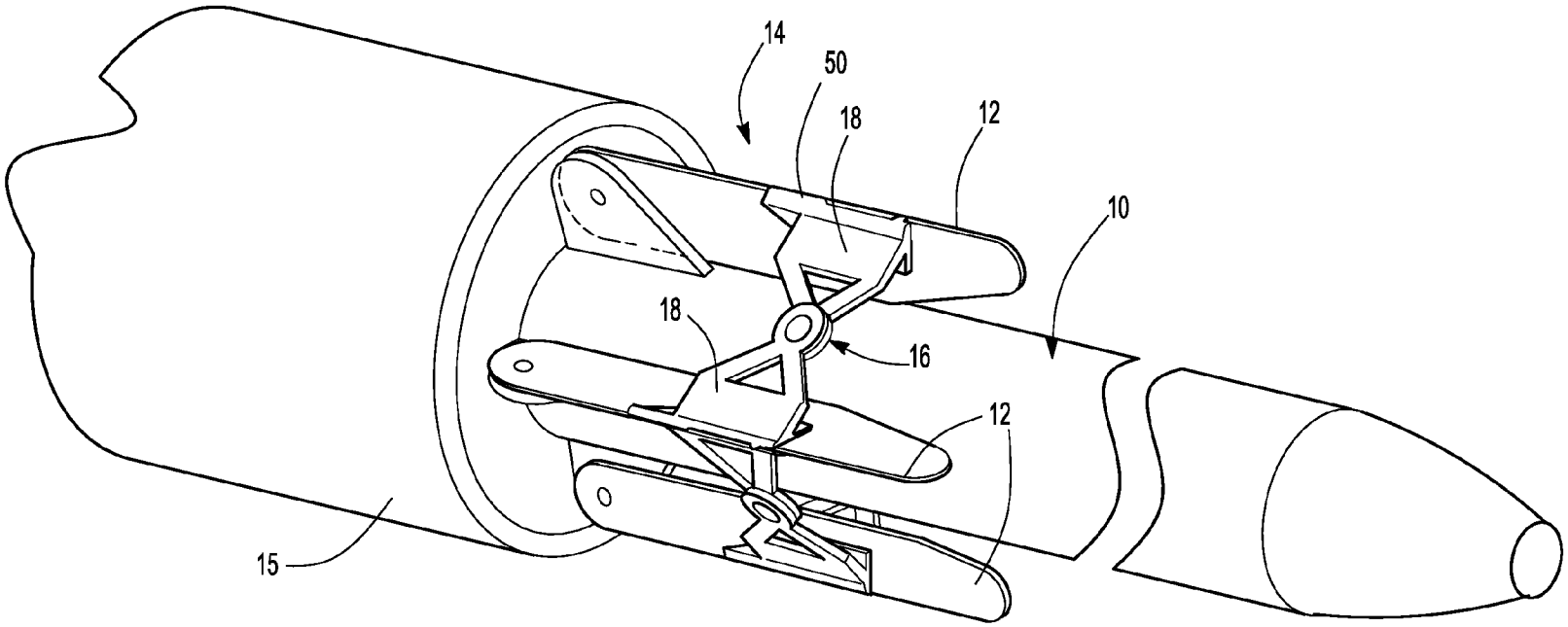
FIG. 1 is an isometric view illustrating a projectile with a preferred embodiment of the retention system.
Figure 4:
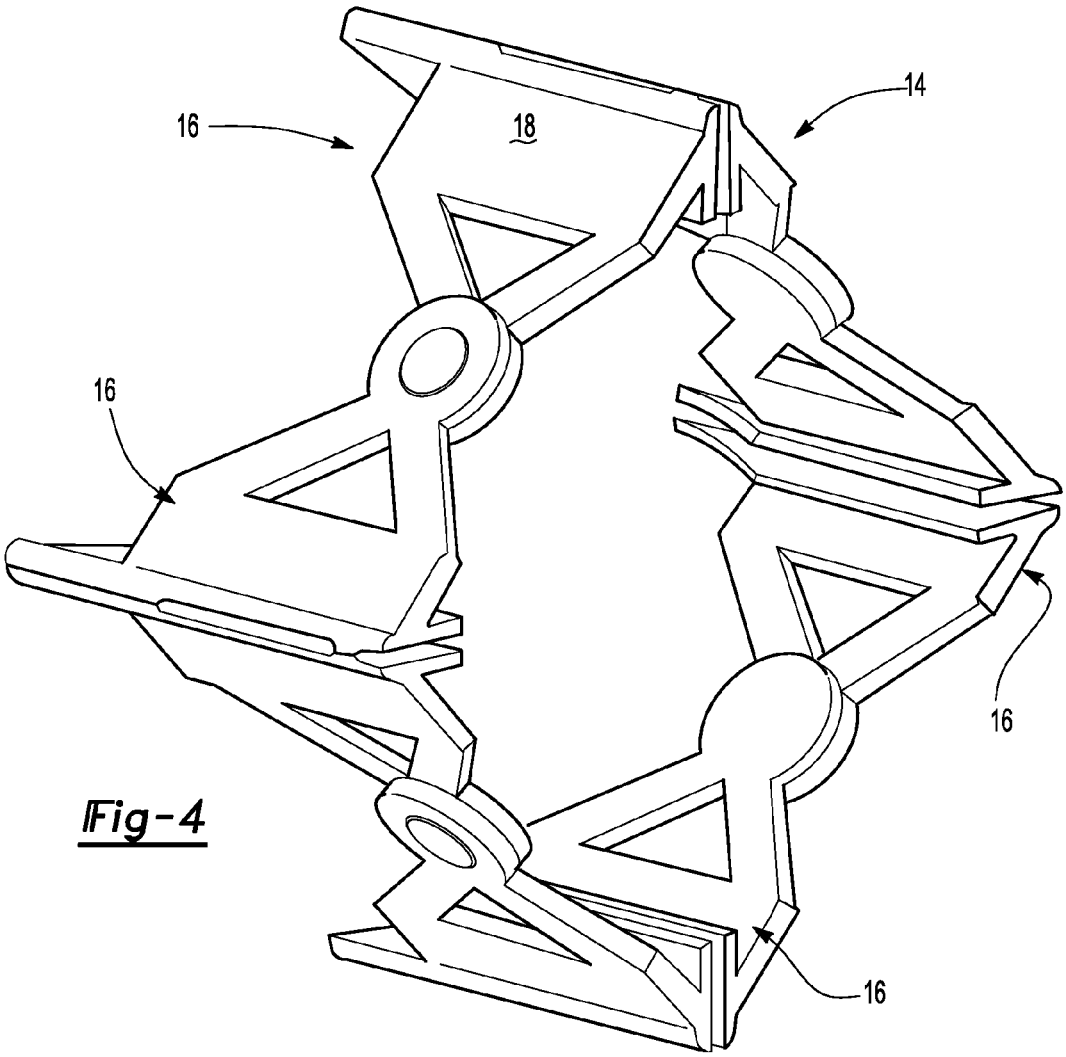
FIG. 4 is an elevational view of an assembled fin retention system.

With reference now to FIGS. 1 and 4, a fin retention system 14 is shown for retaining the fins 12 of the projectile 10 in an undeployed position until immediately after exiting the launch tube after launch. The fin retention system 14 includes a plurality of substantially identical fin retention units 16 wherein one fin retention unit 16 is associated with each fin 12 on the projectile 10.

Figure 3:
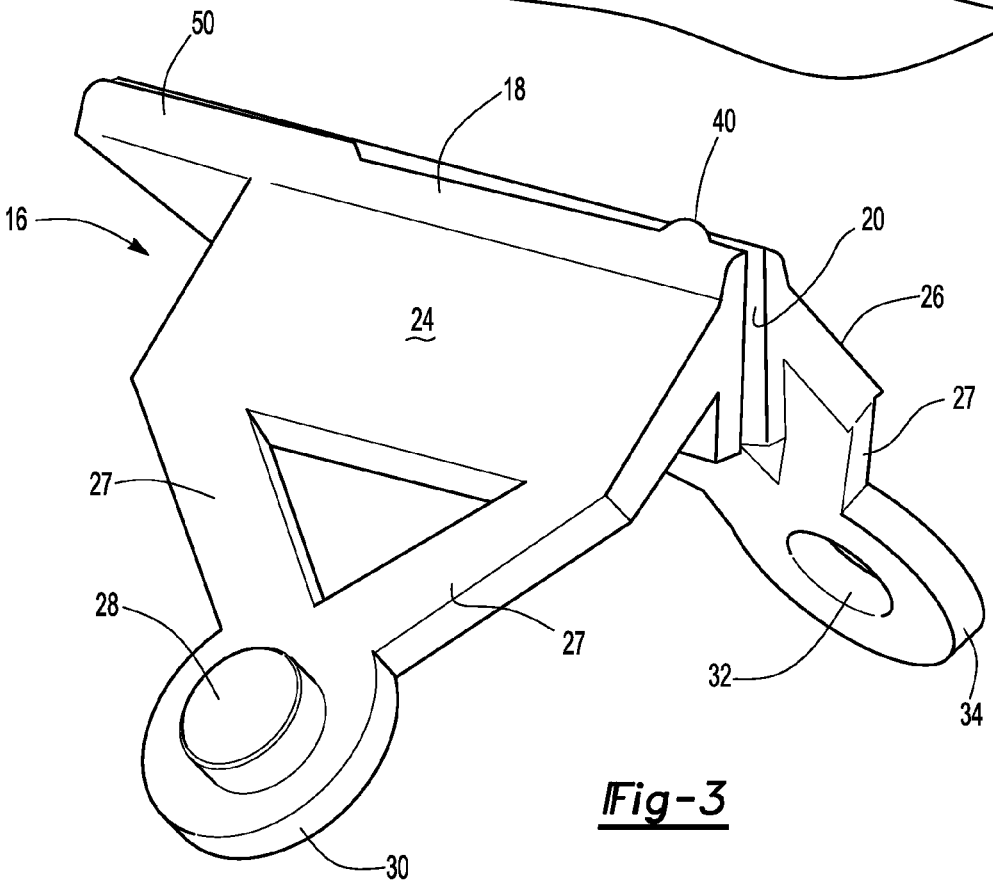
FIG. 3 is an enlarged perspective view illustrating one fin retention unit.

With reference now to FIG. 3, a single fin retention unit 16 is shown, it being understood that a like description shall also apply to the other fin retention units 16. The fin retention unit 16 includes an alignment member 18 having a slot 20 dimensioned to receive its associated fin 12 when its associated fin 12 is in its undeployed position. At least a portion of the alignment member 18 physically or mechanically engages its associated fin 12 when undeployed to thereby hold that fin 12 in its undeployed position.

A pair of span arms 24 and 26, respectively, extends outwardly from opposite sides of the alignment member 18. Each span arm 24 and 26, furthermore, is substantially planar and the span arms 24 and 26 intersect each other at an angle equal to 60, 90, and 108 degrees for a typical projectile 10 with 3, 4, or 5 fins, respectively. Each span arm 24 and 26 also includes a pair of struts 27 which reduces the weight of the retention unit 16.

An attachment device 28 is positioned adjacent a free end 30 of the span arm 24 while a cooperating attachment device 32 is positioned adjacent a free end 34 of the other span arm 26. The attachment devices 28 and 32 selectively lock together in order to secure the adjacent retention units 16 together as shown in FIG. 4. Although any conventional mechanism may be used to secure the attachment devices 28 and 32 together, preferably the attachment device is a snap lock where the attachment device 28 is a snap pin and the attachment device 32 is a snap hole complementary in shape but slightly smaller than the snap pin 28.

Figure 5:
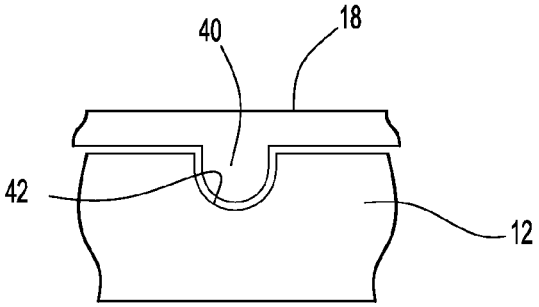
FIG. 5 is a fragmentary enlarged view of a portion of the retention system.

With reference now to FIGS. 2, 3, and 5, with the fin retention unit positioned over its associated fin 12 when the fin 12 is in an undeployed position, a pin 40 on the alignment device 18 registers with and is received within a receiving notch 42 on the projectile fin 12. The mechanical interaction between the pin 40 and the notch 42 on the fin 12 creates a mechanical lock which not only holds the fin 12 in its undeployed position, but also locks the fin retention unit 16 against axial movement relative to its associated fin 12.

In operation the fin retention units 16 are positioned over their associated fins 12 and locked together as shown in FIG. 1. The projectile 10 together with the fin retention system 16 can be loaded into the launch tube 15. Preferably, an outer periphery 50 of the alignment device 18 is rounded in order to prevent damage to the launch tube if the alignment device is made of a material of greater hardness than the launch tube.

For most efficient use, the fin retention system should separate from the projectile immediately after exiting from the launch tube. In order to achieve the separation, two different systems may be used.

First, the fin retention units 16, which are preferably of a one piece construction, may be constructed of a flammable material which ignites during the launch of the projectile and burns through at least the struts 27 on the span arms 24 or 26 before exiting from the launch tube. Thus, upon launch, any remaining portions of the fin retention system will merely separate from the projectile due to inertial and/or aerodynamic drag forces.

Alternatively, the fin retention units 16 may be constructed of an inert and flame-retardant material. In this case, the inertial forces acting on the fin retention unit during the launch will cause the fin retention units 16 to separate from each other and/or fragment. In either case, the fin retention units 16 will separate from the projectile 10 immediately after launch as desired.

From the foregoing, it can be seen that the present invention provides a simple external fin retention unit for use with a projectile having deployable fins. Since the fin retention system of the present invention utilizes no moving parts, it enjoys high reliability in operation. Furthermore, the fin retention units which form the fin retention system may be mass produced thus reducing the overall cost of the fin retention system.

Additional details and advantages of the present invention may be provided in U.S. Army Research Laboratory Technical Report titled "Tactical Means to Stow Super-Caliber Tail-fins of a Developmental Flight-Controlled Mortar" by the present inventors and is hereby incorporated by reference herein.

Having described my invention, many modifications thereto will become apparent to those skilled in the art to which it pertains without deviation from the spirit of the invention as defined by the scope of the appended claims.

We claim:

1. A fin retention system for a projectile having a plurality of deployable fins comprising:

a plurality of fin retention units, each retention unit having an alignment device and a pair of span arms, said span arms extending outwardly from opposite sides of said alignment device, an attachment device positioned adjacent a free end of one of said span arms and a cooperating attachment device positioned adjacent a free end of the other of said span arms, wherein, with the fins of the projectile in an undeployed position, one alignment device is aligned with each fin and the attachment device of each retention unit is attached to said cooperating attachment device of its adjacent retention unit to lock said retention units together and simultaneously hold the fins in an undeployed position.

2. The fin retention system as defined in claim 1 wherein said fin retention units are constructed of a combustible material, that, when burned, does not add appreciably to a launch tube peak pressure or a propelling force behind the projectile during its forward travel within a launch tube.

3. The fin retention system as defined in claim 1 wherein the fins each include a notch and wherein said alignment device includes a pin which cooperates with said notch to lock said alignment unit preventing axial movement with respect to its associated fin.

4. The fin retention system as defined in claim 1 wherein said attachment device and said cooperating attachment device comprise a snap lock having a cooperating male member and female member.

5. The fin retention system as defined in claim 4 wherein said male member comprises a pin and said female member comprises an opening complementary in shape, but slightly smaller in cross-sectional shape than said male member.

6. The fin retention system as defined in claim 4 wherein said male member and said female member are easily mated and un-mated by hand at the original point of assembly or manufacture or in-the-field.

7. The fin retention system as defined in claim 1 wherein each said retention unit is constructed of an inert, flame-retardant material.

8. The fin retention system as defined in claim 1 wherein said retention unit is constructed of either a combustible or inert, flame-retardant material that adds neglible mass to the total projectile weight at launch.

9. The fin retention system as defined in claim 1 wherein said retention units are constructed of either a combustible material or an inert, flame-retardant material that adds neglible mass to the total projectile weight at launch.

10. The fin retention system as defined in claim 3 wherein said retentions unit are constructed of either a combustible material or an inert, flame-retardant material that adds neglible mass to the total projectile weight at launch.

11. The fin retention system as defined in claim 1 wherein each fin retention unit is of a one piece construction allowing for multiple inter-locking units to retain at least 3 independently-deploying fins.

12. The fin retention system as defined in claim 1 wherein said fin retention system is durable enough to keep all fins undeployed during projectile handling and manipulation within a launch tube prior to launch yet be of low enough strength to harmlessly remove itself from the fins and projectile during and/or just after launch.

13. The fin retention system as defined in claim 12 wherein said fin retention system is durable enough to keep all fins undeployed during projectile handling and manipulation within a launch tube prior to launch yet be of low enough strength to harmlessly remove itself from the fins and projectile during and/or just after launch.

14. The fin retention system as defined in claim 1 wherein said span arms are generally planar.

15. The fin retention system as defined in claim 8 wherein each span arm defines a plane and the planes of the span arms on each retention unit intersect each other at an angle equal to 60, 90, and 108 degrees for a projectile with 3, 4, or 5fins, respectively.

16. The fin retention system as defined in claim 9 wherein each span arm defines a plane and the planes of the span arms on each retention unit intersect each other at an angle equal to 60, 90, and 108 degrees for a projectile with 3, 4, or 5fins, respectively.

17. The fin retention system as defined in claim 10 wherein each span arm defines a plane and the planes of the span arms on each retention unit intersect each other at an angle equal to 60, 90, and 108 degrees for a projectile with 3, 4, or 5fins, respectively.

18. A fin retention system for a projectile having a plurality of deployable fins comprising:

a plurality of fin retention units, each retention unit having an alignment device and a pair of span arms, said span arms extending outwardly from opposite sides of said alignment device wherein said fin retention units are constructed of a combustible material, that, when burned, does not add appreciably to a launch tube peak pressure or propelling force behind the projectile during its forward travel within the launch tube and further wherein each fin retention unit is of a one piece construction allowing for multiple inter-locking units to retain 3 to 5 independently-deploying fins, an attachment device positioned adjacent a free end of one of said span arms and a cooperating attachment device positioned adjacent a free end of the other of said span arms wherein said attachment device and said cooperating attachment device comprise a snap lock having a cooperating male member and female member, wherein said male member comprises a snap pin and said female member comprises an opening complementary in shape to said snap pin, but slightly smaller in cross-sectional shape than said male member and further wherein said male member and said female member are easily mated and un-mated by hand at the original point of assembly or manufacture or in-the-field, wherein, with the fins of the projectile in an undeployed position, one alignment device is aligned with each fin and the attachment device of each retention unit is attached to said cooperating attachment device of its adjacent retention unit to lock said retention units together and simultaneously hold the fins in said undeployed position wherein the fins each include a notch and wherein said alignment device includes a pin which cooperates with said notch to lock said alignment unit preventing axial movement with respect to its associated fin.

19. A fin retention system for a projectile having a plurality of deployable fins comprising:

a plurality of fin retention units, each retention unit having an alignment device and a pair of span arms, said span arms extending outwardly from opposite sides of said alignment device wherein each fin retention unit is of a one piece construction allowing for multiple inter-locking units to retain 3 to 5 independently-deploying fins, an attachment device positioned adjacent a free end of one of said span arms and a cooperating attachment device positioned adjacent a free end of the other of said span arms wherein said attachment device and said cooperating attachment device comprise a snap lock having a cooperating male member and female member, wherein said male member comprises a snap pin and said female member comprises an opening complementary in shape to said snap pin, but slightly smaller in cross-sectional shape than said male member and further wherein said male member and said female member are easily mated and un-mated by hand at the original point of assembly or manufacture or in-the-field, wherein, with the fins of the projectile in an undeployed position, one alignment device is aligned with each fin and the attachment device of each retention unit is attached to said cooperating attachment device of its adjacent retention unit to lock said retention units together and simultaneously hold the fins in said undeployed position wherein the fins each include a notch and wherein said alignment device includes a pin which cooperates with said notch to lock said alignment unit preventing axial movement with respect to its associated fin.

20. The fin retention system as defined in claim 19 wherein said retention unit is constructed of either a combustible or inert, flame-retardant material that adds neglible mass to the total projectile weight at launch.

* * * * *